US007364486B2

(12) United States Patent
Serpa

(10) Patent No.: US 7,364,486 B2
(45) Date of Patent: Apr. 29, 2008

(54) WATER RESCUE DEVICE

(76) Inventor: Michael Lawrence Serpa, P.O. Box 478, San Francisco, CA (US) 94104

( * ) Notice: Subject to any disclaimer, the term of this patent is extended or adjusted under 35 U.S.C. 154(b) by 0 days.

(21) Appl. No.: 11/452,753

(22) Filed: Jun. 14, 2006

(65) Prior Publication Data

US 2007/0026750 A1 Feb. 1, 2007

Related U.S. Application Data

(60) Provisional application No. 60/702,424, filed on Jul. 26, 2005.

(51) Int. Cl.
*B63C 9/00* (2006.01)

(52) U.S. Cl. ..... 441/80

(58) Field of Classification Search ..... 441/8, 441/80

See application file for complete search history.

(56) References Cited

U.S. PATENT DOCUMENTS

| | | | | |
|---|---|---|---|---|
| 600,355 | A | | 3/1898 | Burton |
| 2,557,079 | A | | 6/1951 | Cutri |
| 2,817,860 | A | | 12/1957 | Fritz |
| 3,618,150 | A | | 11/1971 | Anselmi |
| 3,748,672 | A | * | 7/1973 | Patrick et al. ..... 441/131 |
| 3,877,096 | A | * | 4/1975 | Scesney ..... 441/6 |
| 4,498,879 | A | | 2/1985 | Burr |
| 4,652,246 | A | | 3/1987 | Thorgeirsson et al. |
| 4,702,715 | A | | 10/1987 | Winick |
| 4,896,620 | A | | 1/1990 | Jones |
| 4,932,910 | A | | 6/1990 | Hayday |
| 5,158,489 | A | | 10/1992 | Araki et al. |
| 5,257,954 | A | | 11/1993 | Mullisen et al. |
| 5,320,566 | A | | 6/1994 | Low, Jr. |
| 5,520,561 | A | * | 5/1996 | Langenohl ..... 441/129 |
| 5,779,511 | A | | 7/1998 | Davidson, Jr. |
| 6,485,344 | B2 | * | 11/2002 | Arias ..... 441/131 |
| 6,508,682 | B1 | * | 1/2003 | Clark ..... 441/40 |
| 6,749,473 | B1 | | 6/2004 | Lower |
| 7,083,483 | B2 | * | 8/2006 | Corlett ..... 441/6 |

* cited by examiner

*Primary Examiner*—Jesús D Sotelo
(74) *Attorney, Agent, or Firm*—Knobbe Martens Olson & Bear, LLP

(57) ABSTRACT

A water rescue device for use in man overboard situations, comprising a foldable frame structure formed from a plurality of individual segments. The device is restrained in a compact storage configuration until needed. When deployed, resilient band or elastic cord material causes the foldable frame structure to assume an unfolded deployed configuration which floats and can be seen by rescuers. In an alternative embodiment, the device also serves as a lifting basket to assist in lifting a victim from the water.

20 Claims, 8 Drawing Sheets

Fig. 4a
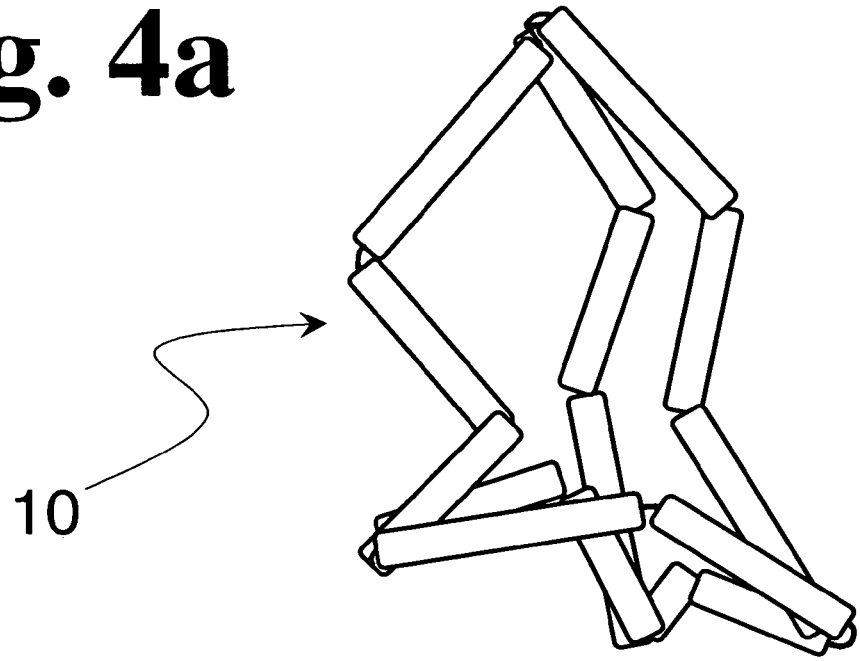
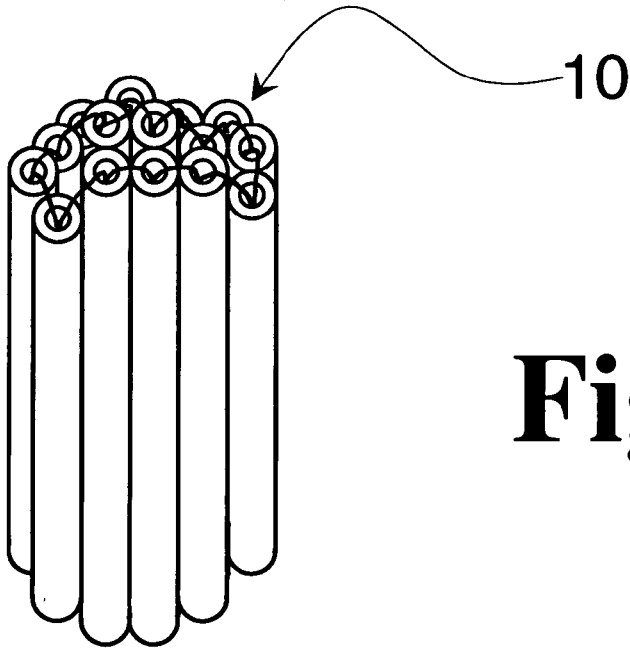
Fig. 4b

WATER RESCUE DEVICE

This applicant claims the priority benefit under 35 U.S.C. 119(e) from U.S. provisional application No. 60/702,424 filed Jul. 26, 2005

FIELD OF THE INVENTION

This invention relates to devices used for the rescue of a person who has fallen overboard from a water-borne vessel. In particular, the invention concerns location-marking, floatation, and lifting devices, which can be deployed into the water when engaged in a rescue.

BACKGROUND OF THE INVENTION

A "man overboard" occurrence is often an emergency of the highest order. Speed in responding to the emergency is critical. The situation can quickly deteriorate, especially if the person in the water is a non-swimmer, is injured, or is in poor health. Matters can be further complicated by other factors—such as cold water, bad weather, darkness, large waves, a strong current, or a limited/inexperienced crew aboard ship responding to the emergency.

A proper response involves maintaining sight of the overboard individual and providing them with floatation. The victim must then be retrieved from the water and given medical care, if necessary. Thus, three distinct issues arise in a successful rescue operation: (i) marking the person's location in the water; (ii) getting a buoyancy device to the person; and (iii) bringing the person on board.

The prior art offers numerous devices designed to address one or more of these issues. Methods range from relatively simple single-purpose designs, such as life rings or horseshoe buoys for providing floatation, to much more sophisticated items employing water-activated strobe lights, satellite communications, radio wave locator beacons, inflatable buoys or floats, etc. There are also a number of arrangements specifically constructed to facilitate the lifting of a person from the water. All of these items have merit, though the best designs are those that are easily and quickly deployable in an emergency, low maintenance, and reliable.

A familiar apparatus for marking the location of a person in the water is the so-called "man overboard pole," which consists of a floating cylindrical buoy that is ballasted at one end to keep it oriented in a particular position when in the water. Extending from the end opposite the ballast is a pole or stick, typically made of fiberglass, with a marker flag at the tip. The pole is dropped into the water near the victim to make it easier to keep sight of them.

Though common in use, the man overboard pole is not without problems. The pole is awkward to store and difficult to deploy quickly, especially if the person deploying the pole is also steering the boat while attempting to maintain eyesight of the victim. These defects are exacerbated by the significant weight of the cylindrical buoy (which is necessary to keep the flag end pointed up while floating in water) making it challenging to handle. And the small marker flag is not easy to see, especially when far away or when weather/darkness limits visibility.

Yet, despite these problems, the man over board pole remains a familiar piece of emergency equipment on many vessels.

There are a few derivative devices that attempt to improve on the basic design of the man overboard pole by using, for example, telescoping poles, but none of these methods solves all of the above problems. A marker device that is easier to store and deploy—and that is more visible when in the water—would be a substantial improvement over the man overboard pole and its related arrangements. Further, if the improved marker device could also include floatation for the victim as well as a means for lifting the victim aboard ship, the benefits offered would be substantial. The present invention provides such a water rescue device in a design that is both durable and low maintenance. It offers a completely novel approach to overboard rescue.

Additional objects and advantages of the invention will be apparent from the following description and drawings of the preferred embodiments.

SUMMARY OF THE INVENTION

The present invention consists of a foldable frame structure formed by a plurality of individual segments. Due to its size and shape when unfolded, the invention—comprising a frame having positive buoyancy—will be far more visible than the man overboard pole which has only a thin stick with a small marker flag; Because of the frame configuration, the preferred embodiments will be much more stable in water than the man overboard pole, especially in the presence of wind and waves; Being foldable, the present invention is also simpler to stow; And since it includes a dynamic aspect resulting from spring means, the water rescue device described here is significantly easier to deploy fast than the man overboard pole and related prior art devices.

When folded, the foldable frame structure assumes a compact storage configuration. In a preferred embodiment resilient band or elastic cord material, such as that used in bungee cords, is employed to provide a force that urges the individual segments from the compact storage configuration into an unfolded deployed configuration. The tension of the elastic cord material would then tend to keep the device in the unfolded deployed configuration. The individual segments can be hollow and the elastic cord material can run through the interior of each individual segment, or the elastic cord material can be tied or otherwise attached to the individual segments at some appropriate point.

In an alternative embodiment, one or more coil springs can be used in place of (or along with) the elastic cord material, though this arrangement might be less desirable for some applications due to corrosion issues. Other factors, such as manufacturing complexity, might also make the elastic cord material a better option.

When in the compact storage configuration, the elastic cord material (and/or the one or more coil springs) will be under greater tension than when the foldable frame structure is in the unfolded deployed configuration. Ideally, the foldable frame structure will be retained in the compact storage configuration by a canister or box that can be opened by a user with a simple release motion upon the occurrence of a man overboard accident, whereupon the foldable frame structure will then fall into the water and assume the unfolded deployed configuration by urging of the elastic cord material. Alternatively, a releasable strap or wrap could be used to restrain the foldable frame structure in the compact storage configuration.

If a canister or box is used to hold the water rescue device, the canister or box can itself be secured with fasteners to a side or stern railing of a boat/ship. This would facilitate easy access to the device in the event of an overboard emergency.

The foldable frame structure may be any suitable shape that can be made foldable, such as a pyramid, a tripod, a diamond, a dome, a cube, a sphere, an egg, etc. (The outline of most any polyhedron would be acceptable, though simpler forms would be preferable to more complex ones.) Each of these shapes would be far more discernible on the water's surface than a prior art man overboard pole and flag. For some applications, shapes having a tendency towards platform stability might be preferred. The individual segments can vary in size and shape depending on the specific embodiment.

Though it might include ballast as discussed below, the foldable frame structure is capable of floating in water.

When deployed in water (in the unfolded deployed configuration), the foldable frame structure of the present invention will protrude above the surface of the water by a predetermined distance to maximize visibility. This predetermined distance can vary depending upon the specific circumstances of use. For example, a height of one meter above the water might be acceptable for coastal areas or on a lake, whereas a greater height possibly will be preferred for offshore or "blue water" locations.

In more sophisticated embodiments the foldable frame structure will assume and maintain a particular—i.e., upright—orientation or position when floating in water. The upright orientation results when a specific end or side of the foldable frame structure is pointed generally in a direction away from the center of the earth. Ballast as well as buoyant material could be incorporated to work in cooperation with the shape of the foldable frame structure to cause the device to reach the upright position—and remain in that position—despite wind or waves. A drogue or sea anchor made from a flexible material might also be appended. (If included, a sea anchor would help prevent the device from drifting too far away from a victim.) Different combinations of these separate components may be utilized with the device of the present invention, and several permutations are possible.

To augment its visual characteristics, the foldable frame structure would preferably be a high-visibility color such as orange, yellow, or red. The device might also include reflective strips and/or marker flags.

The foldable frame structure can also contain auxiliary floatation sufficient to provide buoyancy assistance to a victim, or a separate buoyancy device could be attached to the foldable frame structure to provide this aid. In addition, the present invention may include other accessories such as a strobe light, radio wave locator beacon, or Global Positioning System ("GPS") receiver/position transmitter. It could further have attachment points for other useful items such as signal flares, a whistle, an air horn, dye markers, a communications radio, etc.

Another embodiment of the invention would be large enough to also serve as a lifting basket to help in retrieving the victim from the water, as will be described in detail below.

BRIEF DESCRIPTION OF THE DRAWINGS

FIG. 4*a* is a perspective view of an embodiment shown partially folded.

FIG. 4*b* is a perspective view of an embodiment shown in the compact storage configuration.

DETAILED DESCRIPTION OF THE PREFERRED EMBODIMENTS AND THEIR OPERATION

Figure 1:
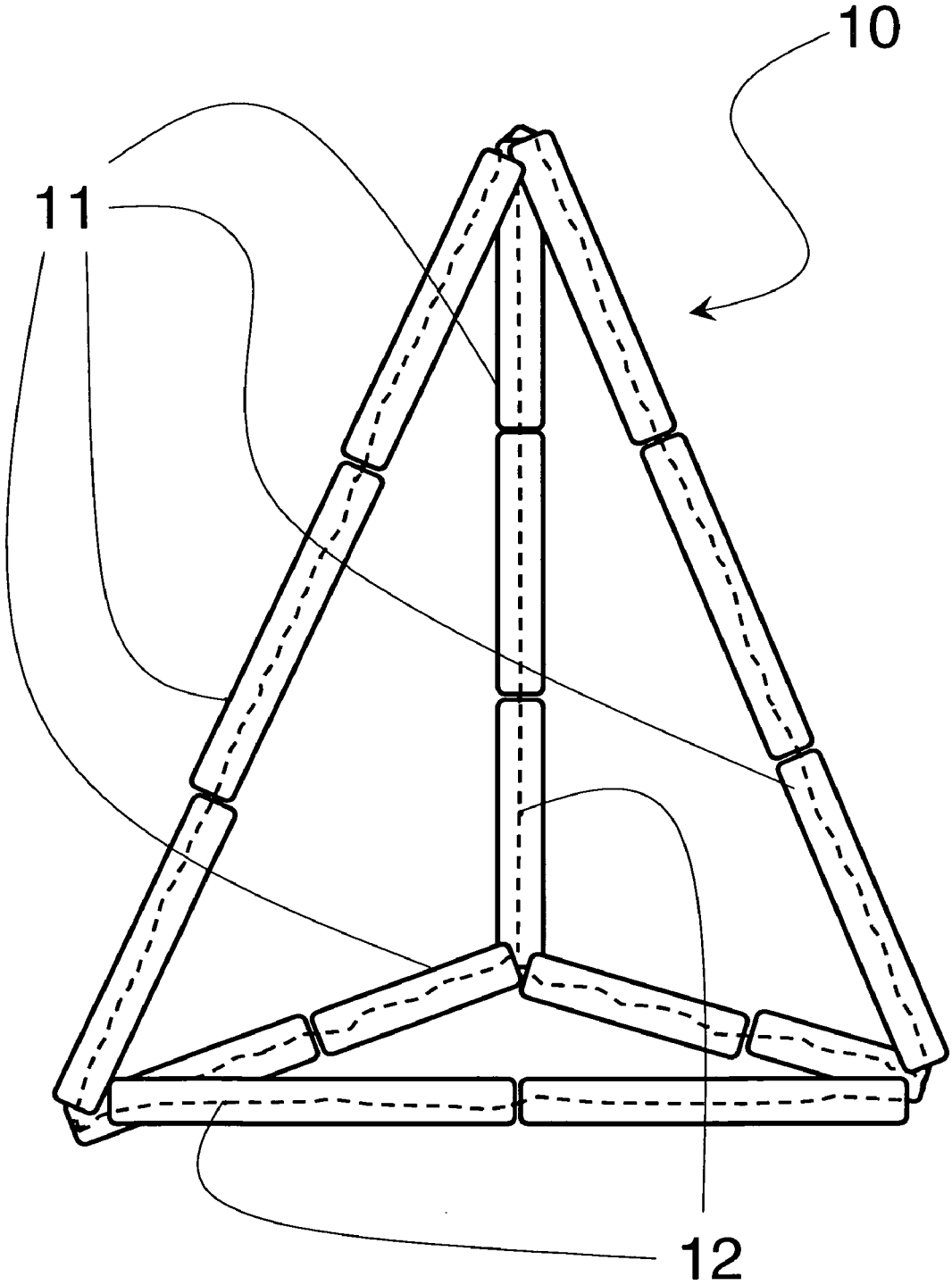
FIG. 1 is a perspective view of a first embodiment shown in the unfolded deployed configuration.

Referring first to FIG. 1, a foldable frame structure 10, shown in the unfolded deployed configuration, is comprised of a plurality of individual segments 11. In this embodiment the individual segments 11 are longitudinal, though they might be shaped differently for other embodiments. The individual segments 11 can be manufactured from any suitable substance, but are preferably made from a durable plastic material of sufficient rigidity. Overall, the foldable frame structure 10 in this embodiment has generally the shape of a tetrahedron.

The number of individual segments 11 included can vary depending upon the particular embodiment of the present invention.

In the embodiment depicted in FIG. 1, the individual segments 11 are hollow and an elastic cord material 12 runs through the interior of each of the individual segments 11. Alternatively, the elastic cord material 12 could be attached or joined to the individual segments 11 at some other point, either on the interior of the individual segments 11 or on their exterior, or a combination of both. Similarly, the elastic cord material 12 might consist of long continuous pieces or, as another option, shorter pieces.

Figure 2:
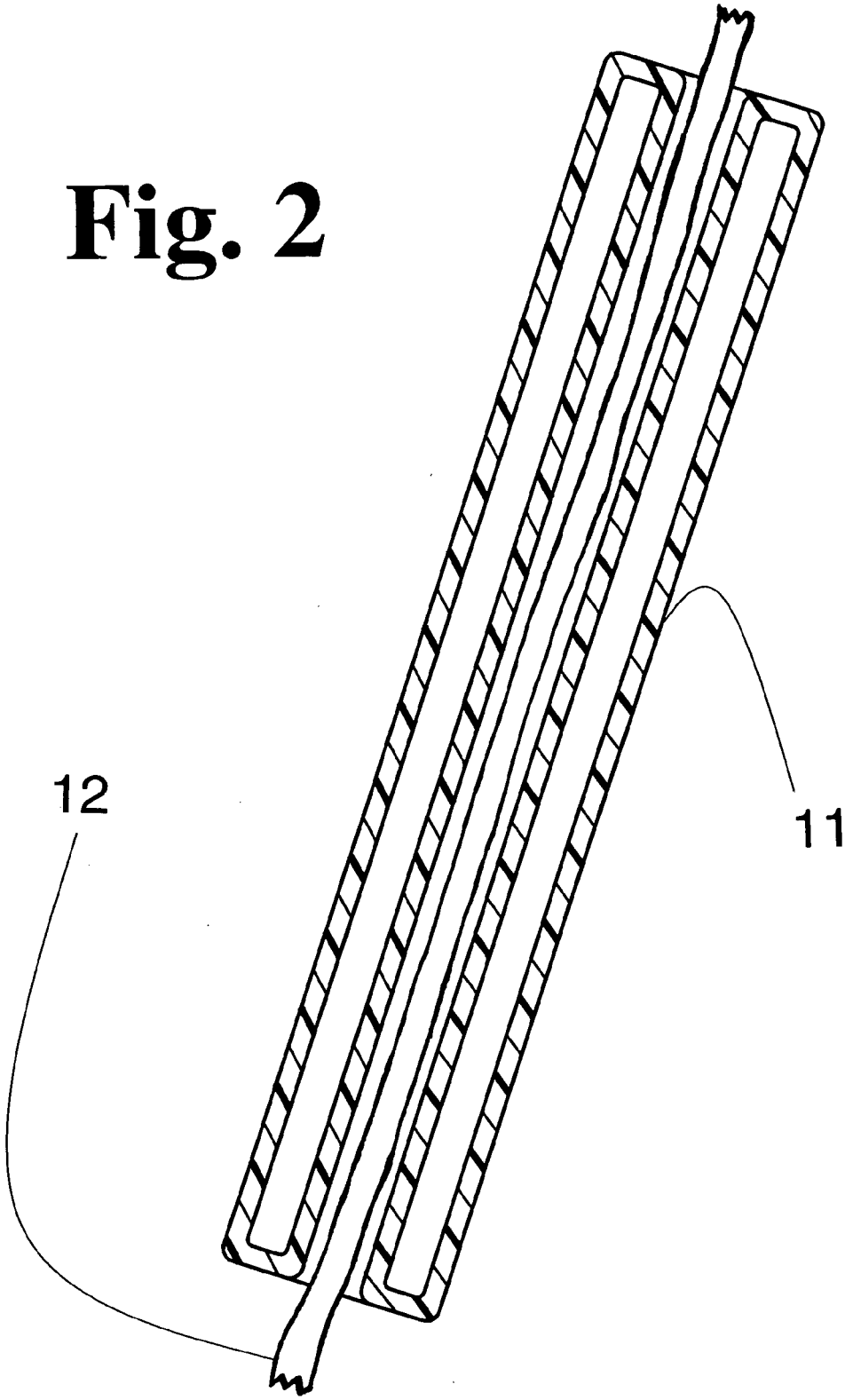
FIG. 2 is a cut-away plan view of one of the individual segments having double-walled construction.

The individual segments 11, if made hollow, can be double-walled such that air is trapped within them to enhance their buoyancy properties. In FIG. 2 is an example of this construction, wherein one of the individual segments 11 is shown cut-away to display the double-walled construction as well as the elastic cord material 12 passing through the hollow interior. Other constructions of the individual segments 11 are possible as well.

Figure 3:
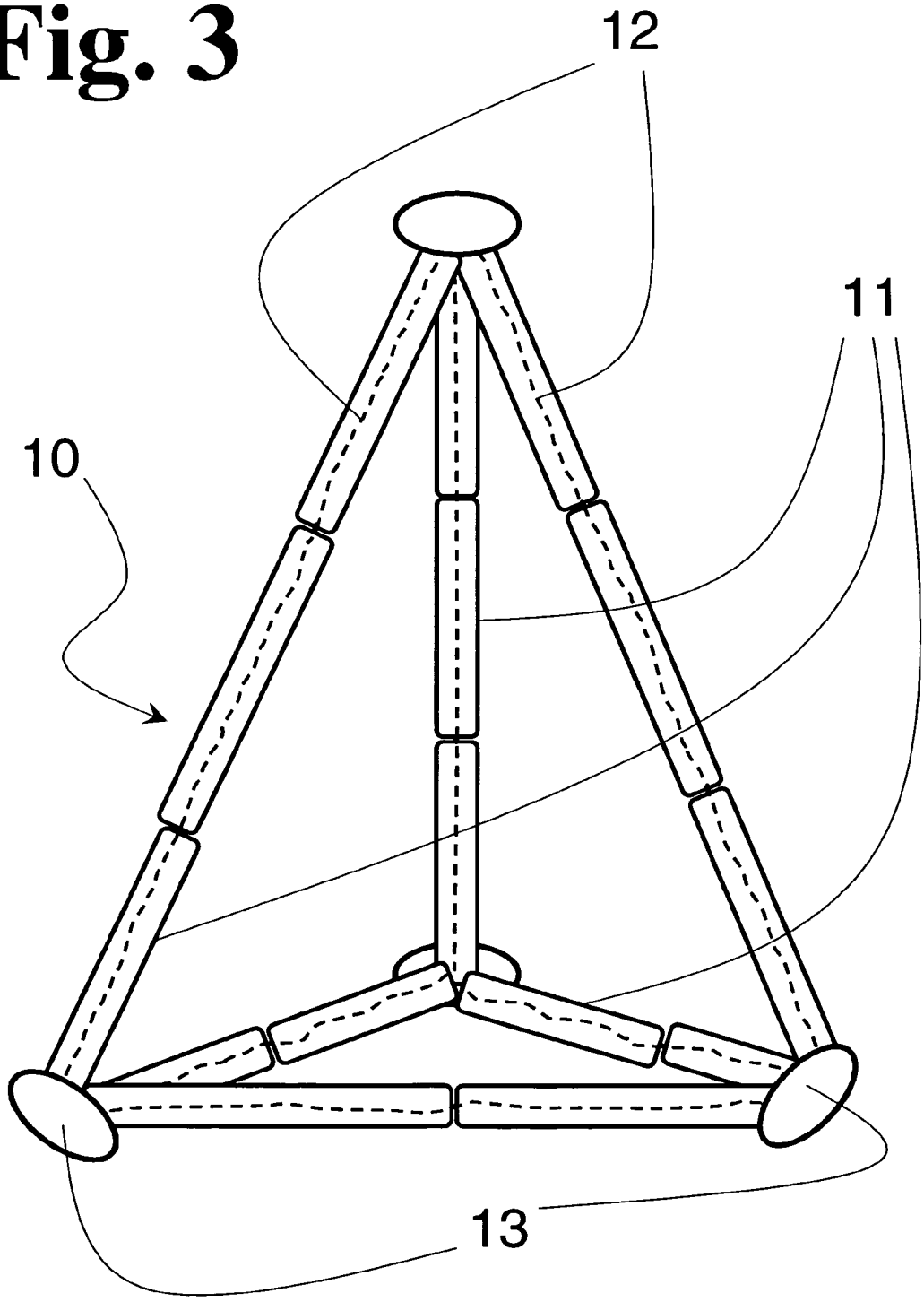
FIG. 3 is a perspective view of a second embodiment.

At places on the foldable frame structure 10 where the elastic cord material 12 must be joined, it can be tied in a knot. Alternatively, the elastic cord material 12 or can be attached, by knot or other suitable method, to one or more corner pieces. Depicted in FIG. 3 is an embodiment including one or more corner pieces 13. If the one or more corner pieces 13 is/are used they can include sockets (not shown) configured to accept the ends of the individual segments 11 to assist the foldable frame structure 10 in maintaining its proper shape when in the unfolded deployed configuration. As with the individual segments 11, the one or more corner pieces 13 may be made from any acceptable material.

Again, as stated above, one or more metal coil springs could replace or assist the elastic cord material 12 in providing the force necessary to urge the frame structure 10 from the compact storage configuration to the unfolded deployed configuration. These embodiments could employ a central spring (mimicking the way a spring-loaded folding umbrella opens), or the embodiments could employ separate springs disposed along, within, or between the individual segments 11.

In FIGS. 4*a* and 4*b* is displayed an example of how the foldable frame structure 10 of FIG. 1 could fold from the unfolded deployed configuration into the compact storage configuration. FIG. 4*a* shows the foldable frame structure 10 partially folded, while FIG. 4*b* illustrates the compact storage configuration. If not restrained in the compact storage configuration, the action of the elastic cord material will cause the device to return to—and for the most part maintain—the unfolded deployed configuration.

As stated above, many distinctive shapes are possible for the foldable frame structure 10. Because different shapes might fold in different patterns, their operation would therefore necessarily diverge from the illustrations of FIGS. 4*a* and 4*b*. All embodiments, however, are capable of a compact storage configuration—though various compact storage configurations may differ in size.

The individual segments 11 can be joined with hinges (not shown), socket joints (not shown), or they can just abut end-to-end as illustrated in FIG. 1. An end-to-end abutment might represent the simplest and most reliable approach if elastic cord material 12 is used.

Figure 5:
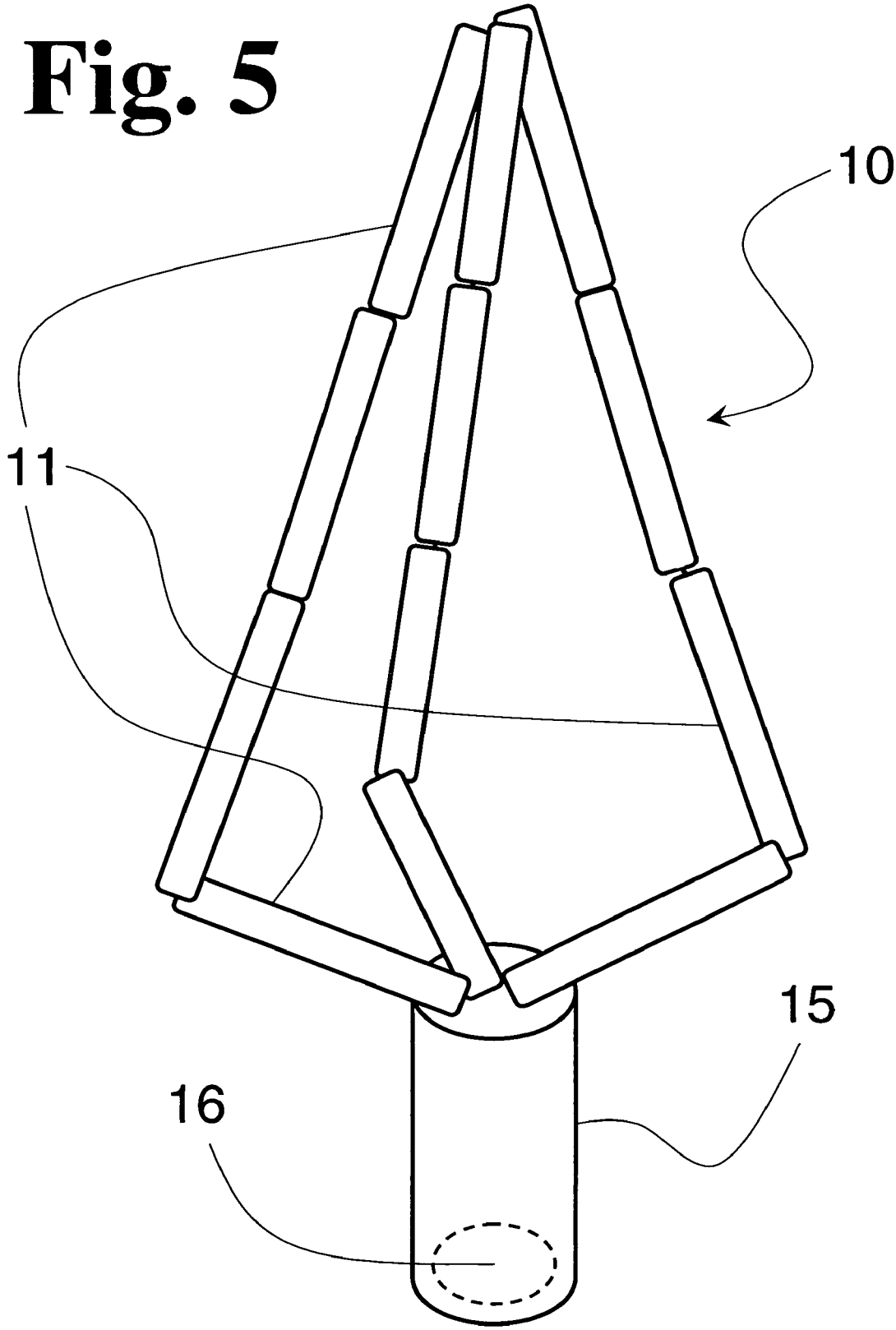
FIG. 5 is a perspective view of an embodiment having a ballasted base.

In FIG. 5 is depicted a modified embodiment that incorporates a ballasted base 15. Housed within, or secured to, the ballasted base 15 is a ballast 16. Ideally, the ballast 16 would be situated so that it will be below the surface of the water when the foldable frame structure 10 is in water in the unfolded deployed configuration. The ballast 16 will function to cause the foldable frame structure 10 to assume and maintain an upright orientation when floating in water. Any appropriate ballasting material, such as lead, can be used for the ballast 16, and the ballast preferably is sufficient in amount to permit the device to function properly in a given situation. The ballasted base 15 can be manufacture from any suitable material, but it is preferably molded from a durable plastic. A cushioning material might also be affixed to prevent the ballasted base 15—as it is falling into water—from causing injury to a person or damage to an object.

For ensuring that the foldable frame structure 10 retains positive buoyancy, the ballasted base 15 could also contain a given amount of floatation material (not shown), such as polystyrene foam, to partially or wholly offset the weight of the ballast.

If the ballasted base 15 has a cavity that can fill with water when the foldable frame structure 10 is deployed, then the ballasted base 15 will double as a sea anchor, further stabilizing the device.

As a separate option, more than one ballasted base 15 could be included with a device of the present invention. This might be appropriate for certain conditions. Furthermore, embodiments of the present invention that include ballast (and can therefore maintain an upright orientation) may support a flagstick extending from the foldable frame structure 10 to increase the visibility of the device.

Figure 6:
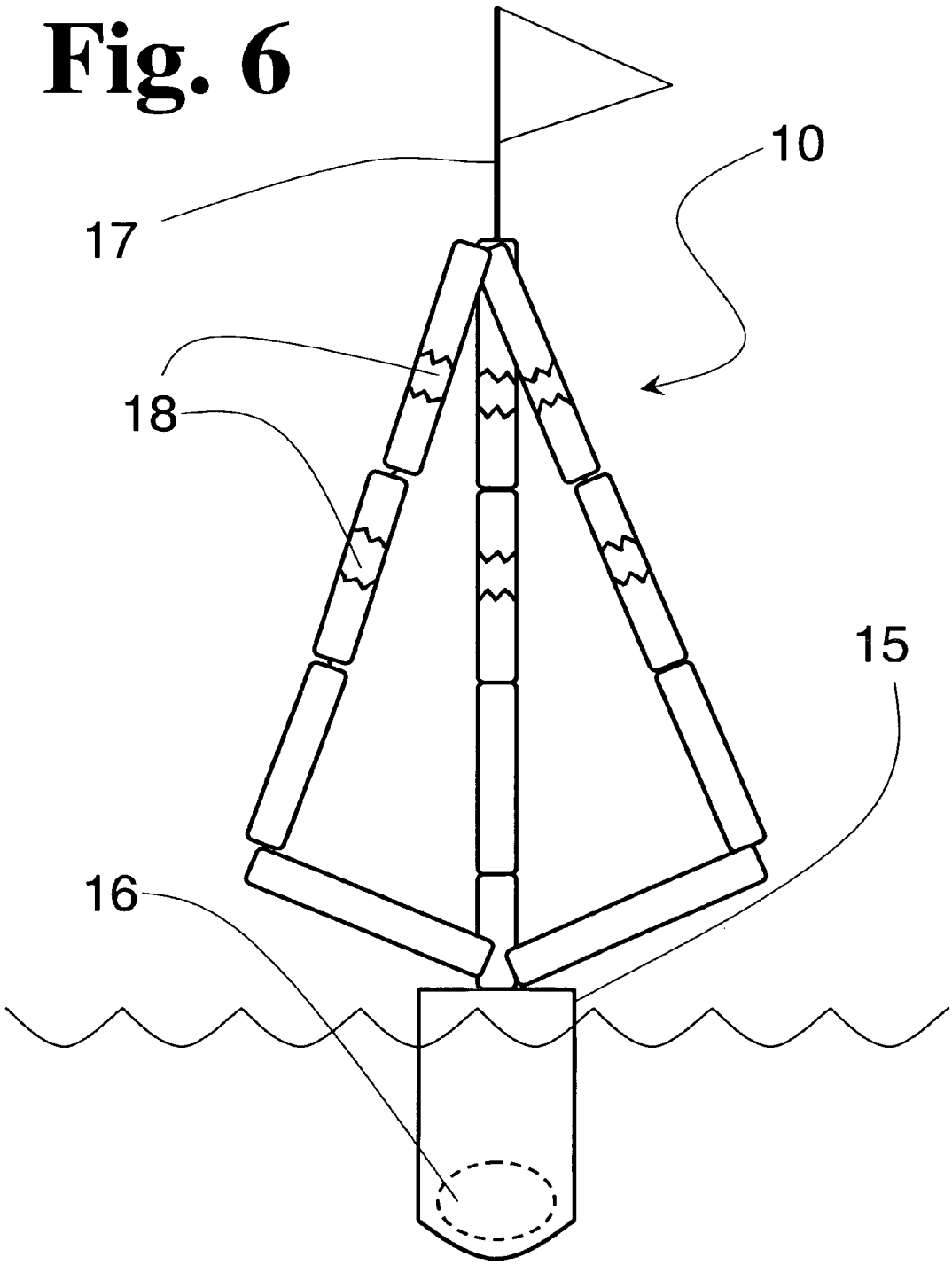
FIG. 6 is a side view of the ballasted base embodiment shown floating in water.

In FIG. 6 is shown a ballasted base 15 embodiment as it would appear when floating in water in the unfolded deployed configuration. The device has assumed an upright orientation as a relatively stable platform and extends above the water by a predetermined distance, and the ballasted base 15 is mostly submerged. This embodiment further incorporates a flagstick 17 and reflective strips 18 to enhance the visibility of the device.

Figure 7:
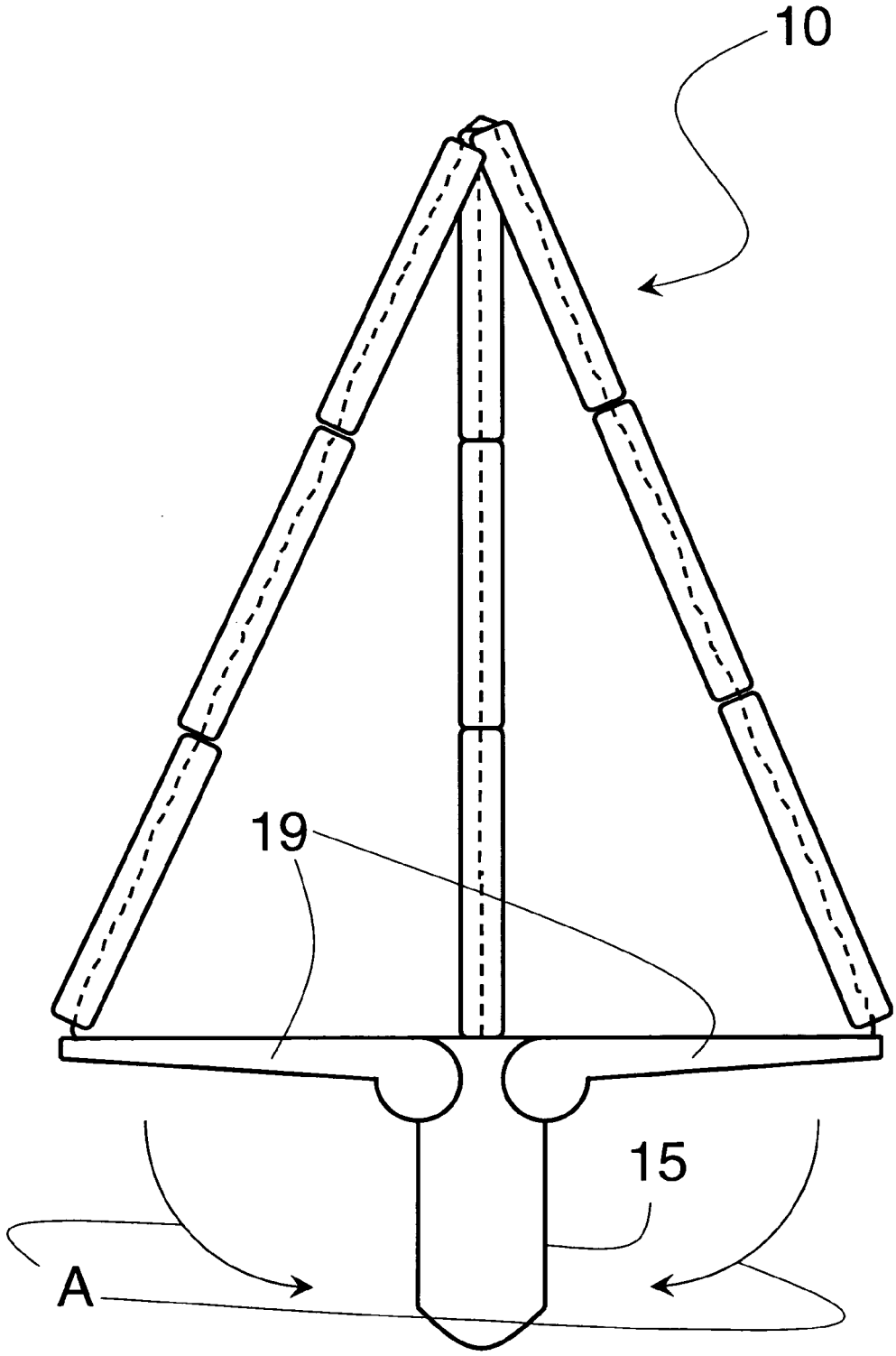
FIG. 7 is a perspective view of an embodiment having a ballasted base that incorporates extendible arms.

An extra feature which may be added to the ballasted base 15 is drawn in FIG. 7. Extendible arms 19 are joined to the ballasted base 15 in a fashion that permits the extendible arms 19 to fold down against the ballasted base 15 when the foldable frame structure 10 is in the compact storage configuration. The function and purpose of the extendible arms is to create a larger, and therefore more stable, base platform for the foldable frame structure 10 when it is floating deployed in water.

In this embodiment, when the foldable frame structure 10 is folded into the compact storage configuration, the extendible arms 19 would be moved generally as indicated by direction arrows "A" and come to a rest against the sides of the ballasted base 15. When the foldable frame structure 10 is deployed, the extendible arms 19 will move in an opposite direction away from the ballasted base 15 as a result of the force of spring means operating on the extendible arms 19. When this occurs, the extendible arms 19 will be in an extended position as depicted in FIG. 7. Resilient band or elastic cord material (not shown) can be used for the spring means, or metal coil/leaf springs (not shown) can be used. The extendible arms 19 themselves can be made from the same material as the ballasted base 15, or from any other acceptable material.

When the device is deployed, the spring means will help retain the extendible arms 19 in the extended position.

If a particular embodiment of the present invention does include ballast, the weight of the ballast could be exploited to automatically provide a floatation ring or buoy to a victim as the water rescue device falls into the water. For example, the floatation ring or buoy could be held aboard ship in a manner that is sufficient to support the floatation ring or buoy itself but is unable to resist the "pulling" force of the ballasted water rescue device when it is being deployed. Many arrangements of this sort are possible. The floatation ring or buoy can even be housed within the same container or box as the device of the present invention.

Figure 8:
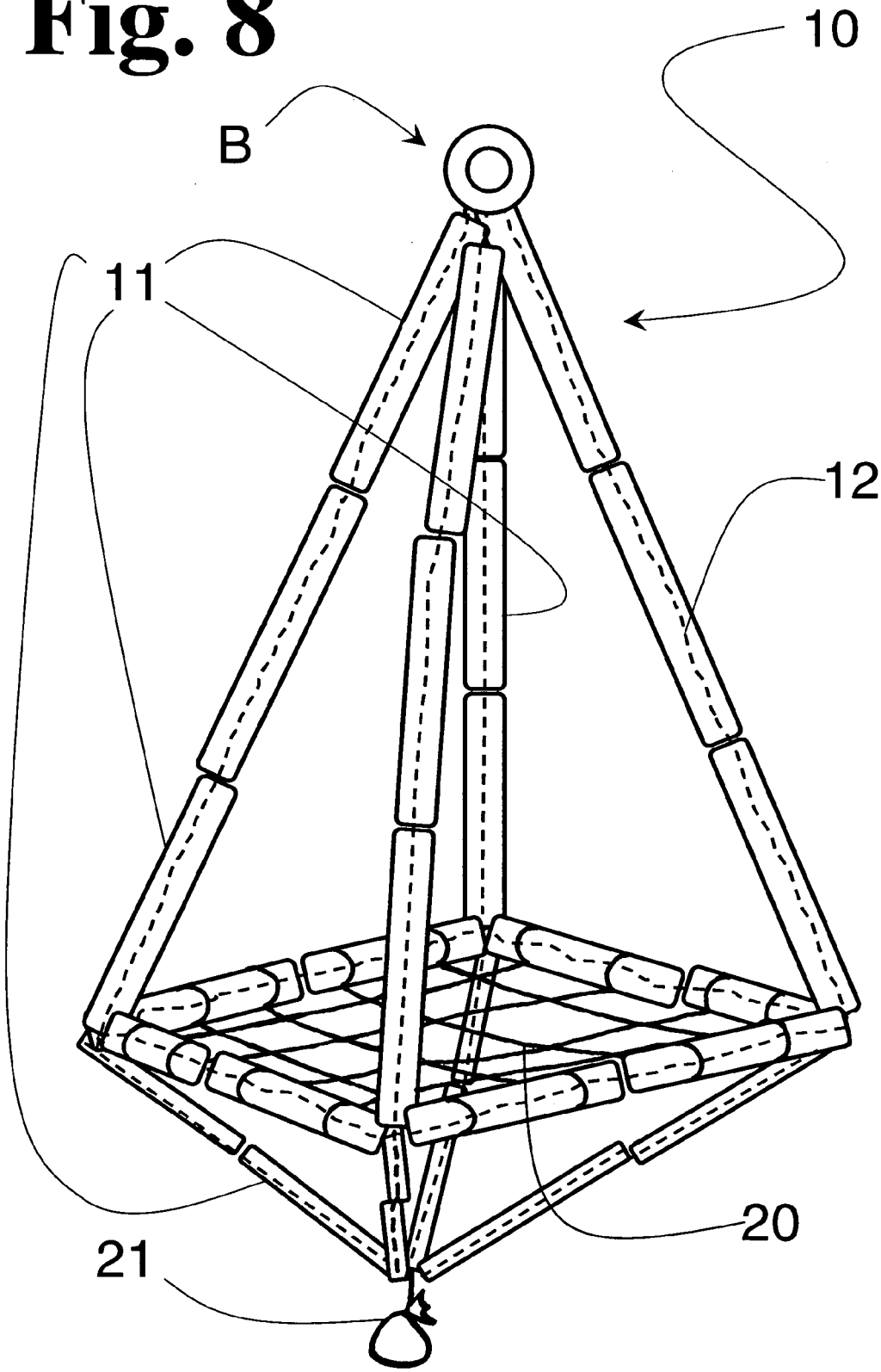
FIG. 8 is a perspective view of an embodiment that can serve as a lifting basket for retrieving a person from the water.

A final embodiment is illustrated in FIG. 8. In this embodiment, the foldable frame structure 10 has generally the form of a four-sided pyramid and is designed to additionally serve as a "lifting basket" to aid in lifting a victim from the water. The embodiment depicted in FIG. 8 has many of the features of the earlier embodiments but with the inclusion of a net or mesh basket 20 strong enough to support the weight of a victim and their water-soaked clothing. The net or mesh basket 20 should be made from a flexible material that can collapse when the foldable frame structure 10 is folded into the compact storage configuration.

Suspended from the individual segments 11 extending below the net or mesh basket 20 is a ballast-containing pouch 21.

Furthermore, this embodiment also has rope (not shown) connected in some fashion to the net or mesh basket 20. (If the individual segments 11 are hollow, the rope could run through the hollow interiors of the individuals segments 11 along with the elastic cord material 12.) The rope should be attached to the net or mesh basket 20 at points sufficient to provide an acceptably even lifting force on the net or mesh basket 20. To accomplish this, multiple pieces of rope may be included. These multiple pieces can converge at a common attachment point such as a loop or metal ring, designated in FIG. 8 as point "B." As with the net or mesh basket 20, the rope should be strong enough to support the weight of a victim (wearing water-soaked clothing). This embodiment should also be sized appropriately to hold a victim, and must be buoyant enough to adequately support the person when floating in water.

Like the net or mesh basket 20, the rope would simply fold up when the device is returned to the compact storage configuration.

In use, a victim would sit or lie on the net or mesh basket 20. A suitable lifting means, such as a block and tackle or a halyard, can then be attached to the foldable frame structure 10 at the common attachment point to lift the victim from the water.

Other modifications to the present invention are possible. For example, a model that can be deployed from a helicopter or other aircraft into water below to effect a rescue would be valuable. Alternatively, an arrangement might be developed that can be remotely deployed by a person who is in the water and in need of rescue.

Although the description above contains several specificities, these should not be construed as limits on the scope of the present invention. The details given are intended merely to provide illustrations of some of the presently preferred embodiments. It is to be therefore understood that many changes and modifications by one of ordinary skill in the art are considered to be within the scope of the invention. Thus, the full scope should be determined by the appended claims and their legal equivalents, rather than by examples given.

I claim:

1. A water rescue device comprising a foldable frame structure;

the foldable frame structure capable of floating in water in an unfolded deployed configuration;

the foldable frame structure further capable of being folded into a compact storage configuration;

the foldable frame structure comprising a ballast housed within a ballasted base; and a resilient band or elastic cord material configured to provide a force for urging the foldable frame structure into the unfolded deployed configuration.

2. The water rescue device of claim 1, wherein the foldable frame structure includes the ballasted base has extendible arms.

3. The water rescue device of claim 1, wherein the foldable frame structure includes corner pieces.

4. The water rescue device of claim 1, further being buoyant enough to adequately support the weight of a victim when floating in water.

5. The water rescue device of claim 1, wherein the foldable frame structure, when in the unfolded deployed configuration, forms the outline of one of the following: a sphere, a dome, an egg, or a polyhedron.

6. The water rescue device of claim 1, wherein the foldable frame structure further includes a flagstick and/or reflective strips.

7. The water rescue device of claim 1, including a net or mesh basket for lifting a victim from water.

8. A water rescue device comprising a foldable frame structure;

the foldable frame structure formed from a plurality of individual segments;

the foldable frame structure capable of being folded into a compact storage configuration;

the foldable frame structure further being capable of unfolding into an unfolded deployed configuration through the action of resilient band or elastic cord material; and the foldable frame structure having sufficient positive buoyancy in water to keep the foldable frame structure afloat without an inflatable device.

9. The water rescue device of claim 8, further including a ballast.

10. The water rescue device of claim 8, further including a net or mesh basket for supporting a victim in a sitting or reclining position.

11. The water rescue device of claim 8, wherein at least one of the individual segments is hollow.

12. The water rescue device of claim 8, further including a ballast housed within a ballasted base.

13. The water rescue device of claim 8, further including a ballast housed within a ballasted base that incorporates extendible arms.

14. The water rescue device of claim 8, further including a marker flag and/or reflective strips.

15. The water rescue device of claim 8, wherein the foldable frame structure forms the outline of a tetrahedron.

16. The water rescue device of claim 8, wherein the foldable frame structure forms the outline of a four-sided pyramid.

17. The water rescue device of claim 8, wherein the foldable frame structure forms the outline of a sphere, a dome, or an egg.

18. The water rescue device of claim 8, further comprising at least one coil spring.

19. A water rescue device comprising a foldable frame structure;

the foldable frame structure capable of floating in water in an unfolded deployed configuration;

the foldable frame structure further capable of being folded into a compact storage configuration; and a resilient band or elastic cord material configured to provide a force for urging the foldable frame structure into the unfolded deployed configuration, wherein the resilient band or elastic cord material that is configured to provide the force for urging the foldable frame structure into the unfolded deployed configuration is not a coilable spring.

20. A water rescue device comprising a foldable frame structure;

the foldable frame structure capable of floating in water in an unfolded deployed configuration, wherein the unfolded deployed configuration of the foldable frame structure forms the outline of one of the following: a sphere, a dome, an egg, or a polyhedron;

the foldable frame structure further capable of being folded into a compact storage configuration; and a resilient band or elastic cord material configured to provide a force for urging the foldable frame structure into the unfolded deployed configuration.

* * * * *